United States Patent [19]

McFarland

[11] 4,091,984

[45] May 30, 1978

[54] SIFT-PROOF, SHIPPING AND DISPENSING CONTAINER

[75] Inventor: William W. McFarland, Wooster, Ohio

[73] Assignee: International Paper Company, New York, N.Y.

[21] Appl. No.: 835,382

[22] Filed: Sep. 21, 1977

[51] Int. Cl.[2] ..... B65D 13/00; B65D 5/72

[52] U.S. Cl. ..... 229/23 BT; 206/606; 206/491; 229/16 R

[58] Field of Search ..... 206/606, 607, 491, 521; 229/32, 36, 14 R, 16 R, 23 BT

[56] References Cited

U.S. PATENT DOCUMENTS

| | | | |
|---|---|---|---|
| 2,171,717 | 9/1939 | Vogt | 229/14 BE |
| 2,348,377 | 5/1944 | Goodyear | 206/607 |
| 2,630,263 | 3/1953 | Ringler | 229/31 FS |
| 2,692,078 | 10/1954 | Lange | 229/16 R |
| 2,912,153 | 11/1959 | Lange | 229/16 R |
| 3,130,891 | 4/1964 | Lange-Wiehe | 229/16 R |
| 3,291,372 | 12/1966 | Saidel | 206/606 |
| 3,743,169 | 7/1973 | Person | 229/16 A |
| 3,910,482 | 10/1975 | Bamburg et al. | 229/14 R |

*Primary Examiner*—Davis T. Moorhead
*Attorney, Agent, or Firm*—Richard J. Ancel

[57] ABSTRACT

A sift-proof, shipping and dispensing container is provided. It comprises an inner container fabricated from a unitary blank and a separate outer container, also fabricated from a unitary blank. It is constructed from a rigid material such as corrugated board. The inner container comprises a bottom wall; first, second, third and fourth side walls hingedly connected to the bottom wall along score lines; pairs of primary gusset panels hingedly connecting the side edges of the first and second, second and third, third and fourth, and fourth and first side walls, wherein the primary gusset panels and the side walls are of equal height, and wherein the primary gusset panels overlie the outer surfaces of the second and fourth side walls when the container is in erected condition; top walls hingedly connected to the first and third side walls along transverse score lines parallel to the score lines connecting the first and third side walls to the bottom wall; tuck-in flaps hingedly connected to the top walls along transverse score lines; and pairs of secondary gusset panels hingedly connecting the top edges of the primary gusset panels which are connected to the first and third side walls to the side edges of the top walls. The outer container comprises: four side walls, end walls hingedly connected to opposite end edges of each of the side walls to form top and bottom walls; and a tear strip encircling the upper end of the outer container to permit separation thereof into cover and body sections.

8 Claims, 10 Drawing Figures

SIFT-PROOF, SHIPPING AND DISPENSING CONTAINER

BACKGROUND OF THE INVENTION

This invention relates to containers which may be employed for the packing, storage, shipping and dispensing of pourable, moisture sensitive materials, such as dyes, which are in powdered or granular form. This invention is particularly concerned with providing a container constructed from a rigid material, such as corrugated board, which protects the contents thereof against damage by moisture and permits the dispensing of the contents by means of an integral pour spout. The container is readily recloseable to protect its contents.

Currently, moisture sensitive materials such as dye stuffs, are packaged and shipped in metal drums, solid fiber drums having metal lids, or cartons having internal plastic bags or liners. The containers of the present invention provide many advantages over the aforementioned presently available containers. For example, the containers are easily disposed of after use, are less expensive to manufacture, are lower in weight and are of more efficient design, which saves warehouse space.

SUMMARY OF THE INVENTION

The present invention provides a sift-proof, moisture-proof, high-strength shipping and dispensing container for the packaging of materials, such as dyes, which are damaged by moisture. It comprises an inner container fabricated from a unitary blank and a separate outer container, also fabricated from a unitary blank. It is constructed from a rigid material such as corrugated board. The inner container comprises a bottom wall; first, second, third and fourth side walls hingedly connected to the bottom wall along score lines; pairs of primary gusset panels hingedly connecting the side edges of the first and second, second and third, third and fourth, and fourth and first side walls, wherein the primary gusset panels and the side walls are of equal height, and wherein the primary gusset panels overlie the outer surfaces of the second and fourth side walls when the container is in erected condition; top walls hingedly connected to the first and third side walls along transverse score lines parallel to the score lines connecting the first and third side walls to the bottom wall; tuck-in flaps hingedly connected to the top walls along transverse score lines; and pairs of secondary gusset panels hingedly connecting the top edges of the primary gusset panels which are connected to the first and third side walls to the side edges of the top walls. The top walls, secondary gusset panels and tuck-in flaps cooperate to form a pair of recloseable pour spouts which permit dispensing of the contents of the container. The outer surfaces of the inner container are coated with a thermoplastic material, such as polyethylene, which renders the container moisture-proof. The outer container comprises: four side walls; end walls hingedly connected to opposite end edges of each of the side walls to form top and bottom walls; and a tear strip encircling the upper end of the outer container to permit separation thereof into cover and body sections.

The full nature of the present invention will be understood from the accompanying drawings and the following description and claims.

DETAILED DESCRIPTION OF THE INVENTION

Figure 1:
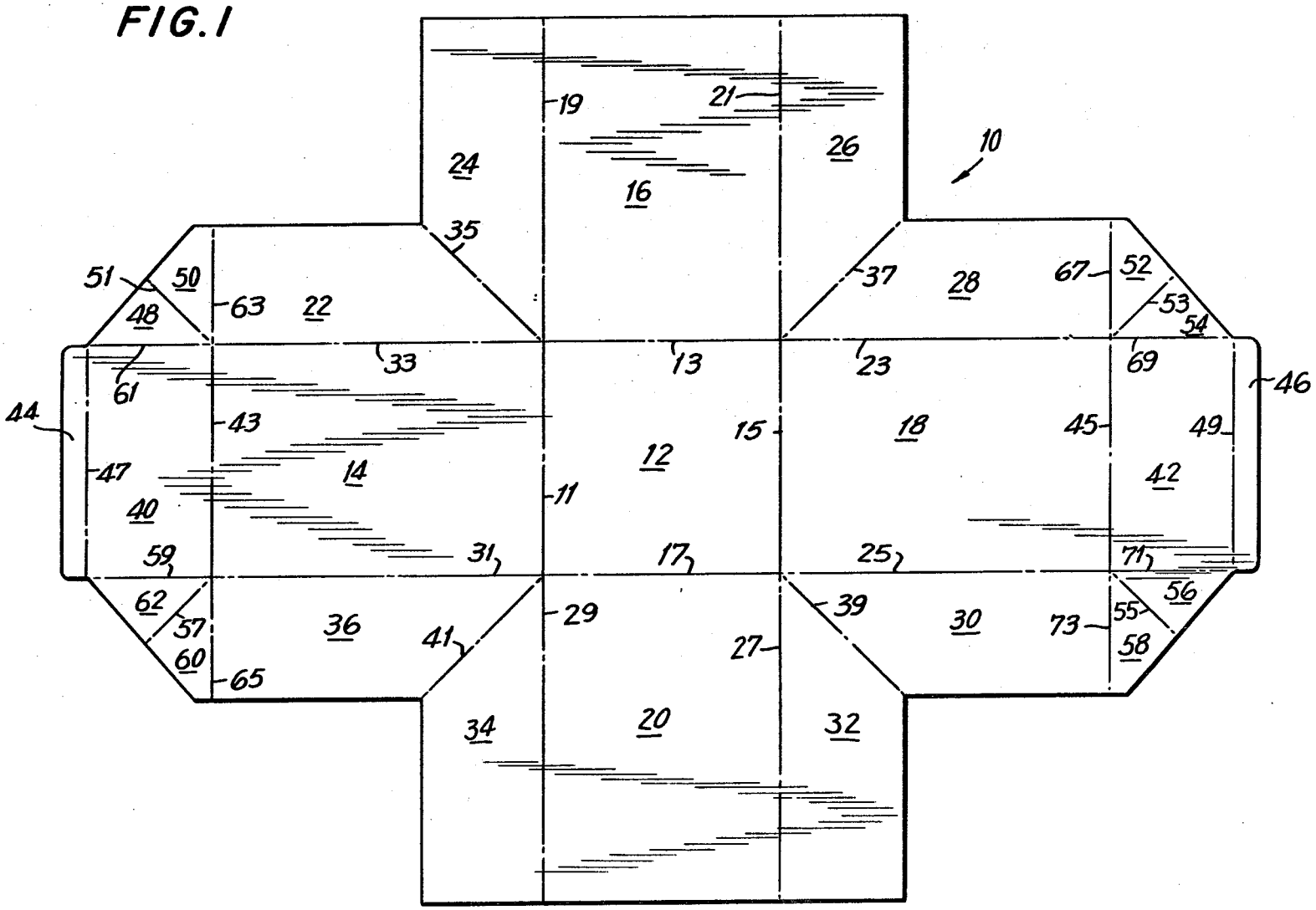
FIG. 1 is a plan view of a cut and scored blank which is used to form the inner container illustrated in FIG. 8.
Figure 5:
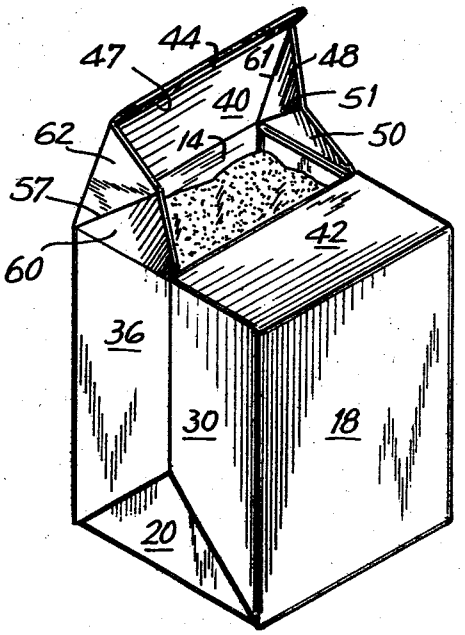
FIG. 5 depicts the next step in the folding sequence of the inner container.
Figure 6:
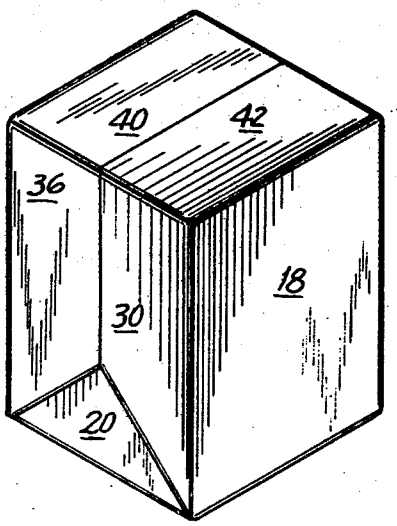
FIG. 6 is a perspective view of the folded and sealed inner container.
Figure 8:
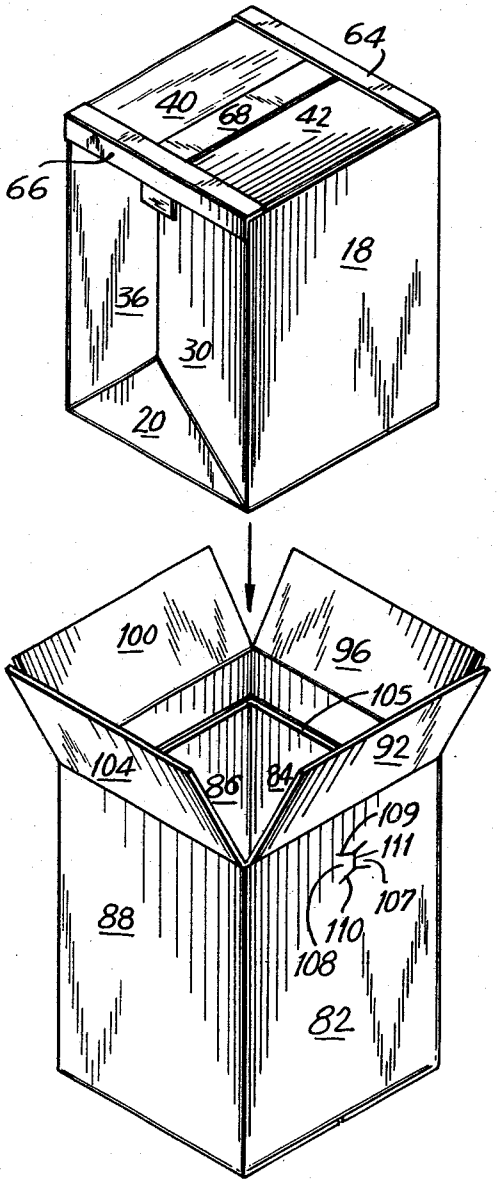
FIG. 8 is an exploded, perspective view of the container of this invention in one state of its erection.
Figure 7:
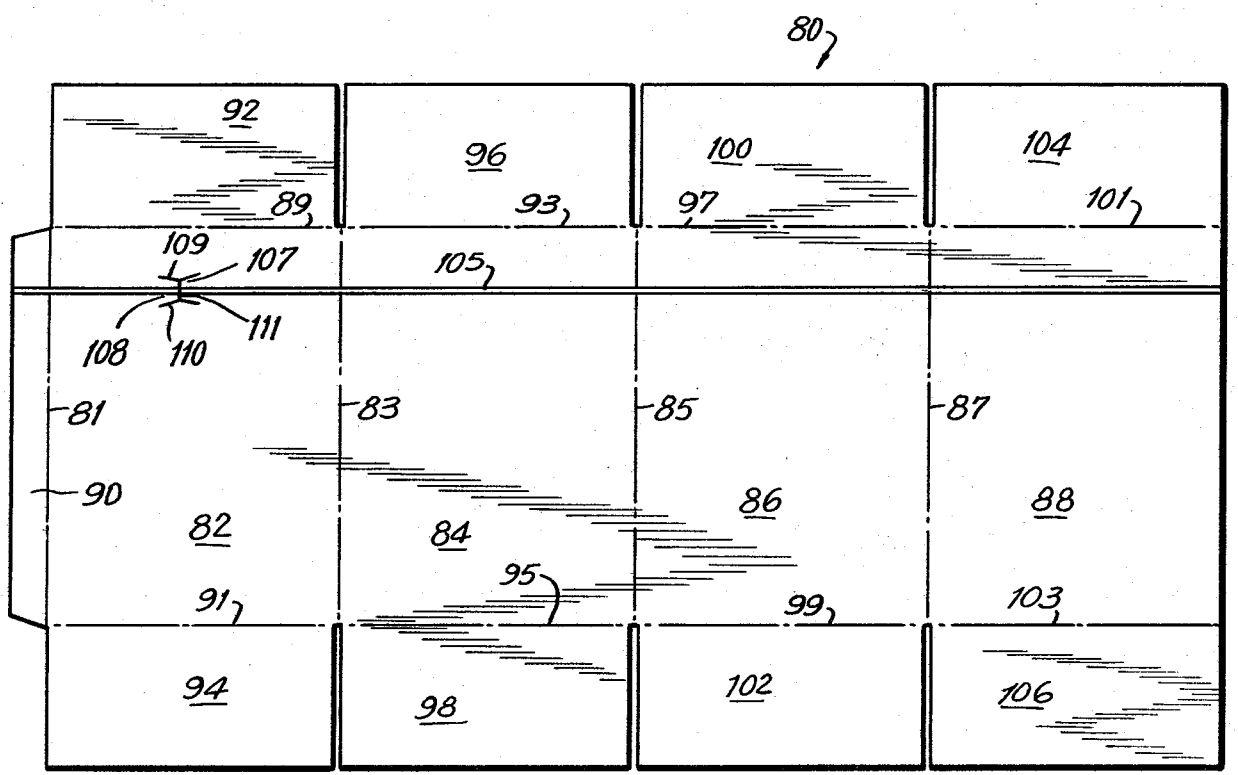
FIG. 7 is a plan view of a cut and scored blank which is used to form the outer container illustrated in FIG. 8.
Figure 10:
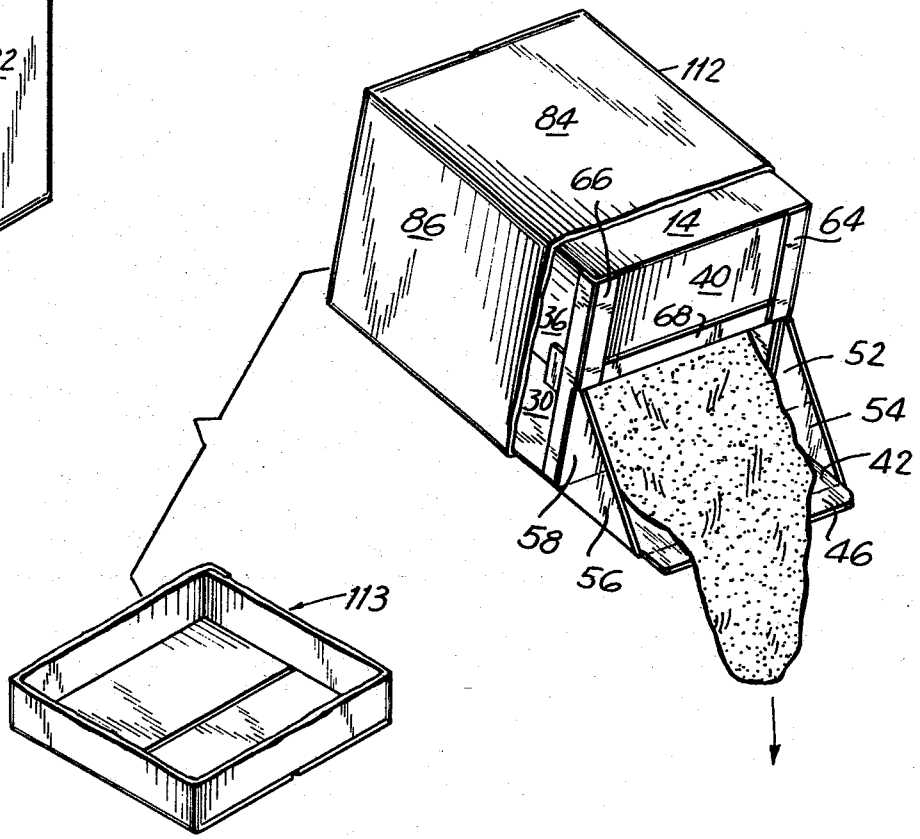
FIG. 10 is an exploded, perspective view of the container performing its dispensing function.
Figure 9:
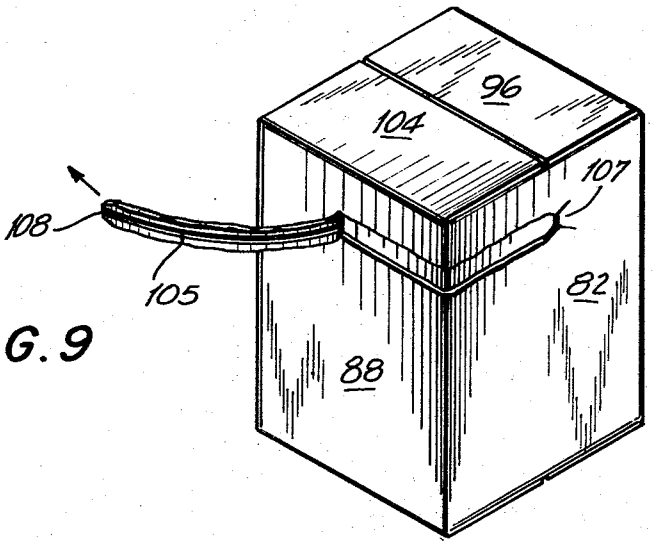
FIG. 9 is a perspective view of the container of this invention illustrating the manner in which access to its contents is provided.

Referring in more detail to the drawings, wherein the same reference numerals are used to designate like structural elements in the figures throughout, FIGS. 1–6 and 8 depict the inner container of this invention, FIGS. 7–8 depict the outer container of this invention, and FIGS. 9 and 10 depict the complete container. As shown in FIG. 1, blank 10 is of generally cruciform shape. It can be formed from a rigid material, preferably corrugated board. Generally, for a container filled with the product to be packaged, having a gross weight of 25 kgs., the blank may be made of 200 or 275 test, B-flute corrugated board. Blank 10 can be coated on one or both sides, and preferably on its outer side, with a polyolefin, such as polyethylene or a like material, to provide a moisture barrier to protect the contents packaged therewithin.

As seen in FIG. 1, blank 10 comprises bottom wall 12, which is defined by score or fold lines 11, 13, 15 and 17. First side wall 14, second side wall 16, third side wall 18 and fourth side wall 20 are hingedly connected to bottom wall 12 along score lines 11, 13, 15 and 17 respectively. First side wall 14 is hingedly connected along a side edge to second side wall 16 by means of a pair of primary gusset panels 22, 24 which, in turn, are hingedly connected along diagonal score line 35. The side edges of second side wall 16 and third side wall 18 are hingedly connected by means of a second pair of primary gusset panels 26 and 28 which are, in turn, hingedly connected by means of diagonal score line 37. The side edges of third side wall 18 and fourth side wall 20 and hingedly connected by means of a third pair of primary gusset panels 30 and 32 which are, in turn, hingedly connected by score line 39. The side edges of first side wall 14 and fourth side wall 20 are hingedly connected by means of a fourth pair of primary gusset panels 34 and 36 which are, in turn, hingedly connected by diagonal score line 41. Preferably, the primary gusset panels 22, 24, 26, 28, 30, 32, 34, and 36 and side walls 14, 16, 18 and 20 are of equal height. First side wall 14 is hingedly connected to primary gusset panels 22 and 36 by means of score lines 33, 31 respectively. Second side wall 16 is hingedly connected to primary gusset panels 24, 26 by score lines 19, 21 respectively. Third side wall 18 is hingedly connected to primary gusset panels 28, 30 by score lines 23, 25 respectively. Fourth side wall 20 is hingedly connected to primary gusset panels 32, 34 by score lines 27, 29 respectively.

Top walls 40 and 42 are hingedly connected to first and third side walls 14 and 18 respectively by means of transverse score lines 43, 45 respectively, which are parallel to score lines 11, 15. Tuck-in flap 44 is hingedly connected to top wall 40 by transverse score line 47. Tuck-in flap 46 is hingedly connected to top wall 42 by transverse score line 49.

One side edge of top wall 40 is connected to the top edge of primary gusset panel 22 by means of a pair of secondary gusset panels 48 and 50 which are, in turn, connected by diagonal score line 51. Wall 40 is hingedly connected to panel 48 by score line 61, and primary gusset panel 22 is hingedly connected to secondary gusset panel 50 by score line 63. The other side edge of top wall 40 is hingedly connected to the top edge of primary gusset panel 36 by means of a pair of secondary gusset panels 60 and 62, which are, in turn, hingedly connected by score line 57. Top wall 40 is hingedly connected to secondary gusset panel 62 by score line 59, and primary gusset panel 36 is hingedly connected to secondary gusset panel 60 by score line 65.

In a like manner, one side edge of top wall 42 is hingedly connected to the top edge of primary gusset panel 28 by a pair of secondary gusset panels 52, 54 which are, in turn, hingedly connected by diagonal score line 53. Secondary gusset panel 52 is hingedly connected to the top edge of primary gusset panel 25 by score line 67. The side edge of top wall 42 is hingedly connected to secondary gusset panel 54 by score line 69. The other side edge of top wall 42 is hingedly connected to the top edge of primary gusset panel 30 by a pair of secondary gusset panels 56, 58 which are, in turn, hingedly connected by diagonal score line 55. Score line 71 hingedly connects the side edge of top wall 42 to secondary gusset panel 56. Score line 73 hingedly connects the top edge of primary gusset panel 30 to secondary gusset panel 58.

Figure 2:
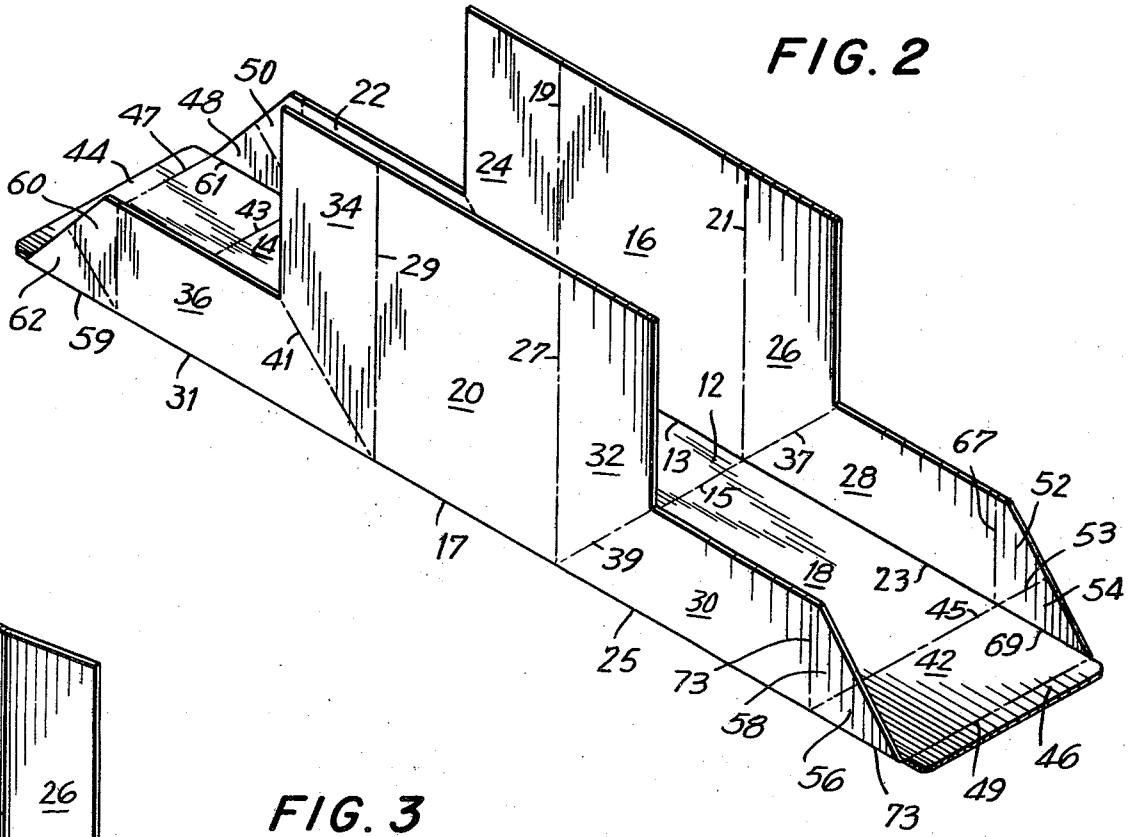
FIG. 2 is a perspective view of the inner container of the invention in one state of its erection.

The blank may be stored and shipped in a flat or knocked-down position. When it is desired to be erected into a container, it is folded in the sequence depicted in FIGS. 2–6. As shown in FIG. 2, the secondary gusset panels 48, 50, 52, 54; primary gusset panels 22, 24, 26, 28; and second side wall 16 are folded as a unit about score lines 61, 33, 13, 23 and 69 until they are perpendicular to bottom wall 12. In a like manner, the secondary gusset panels 56, 58, 60, 62; primary gusset panels 30, 32, 34, 36; and fourth side wall 20 are folded as a unit about score lines 59, 31, 17, 25 and 71, until they are perpendicular to bottom wall 12.

Figure 3:
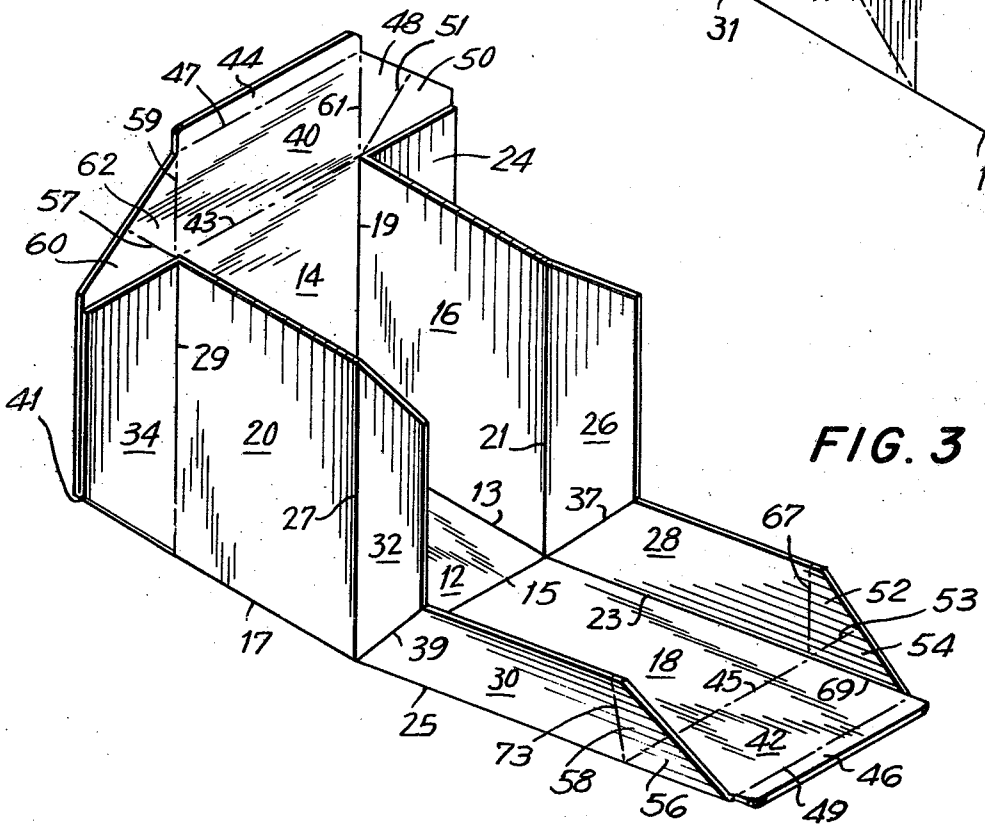
FIG. 3 depicts the next step in the folding sequence of the inner container.

As shown in FIG. 3, primary gusset panels 22, 23, 34, 36 and first side wall 14 are folded about score lines 19, 11, 29 to a position perpendicular to bottom wall 12. This causes the pairs of gusset panels 22, 24, and 34, 36 to fold about their respective diagonal score lines 35, 41 into face-to-face position.

Figure 4:
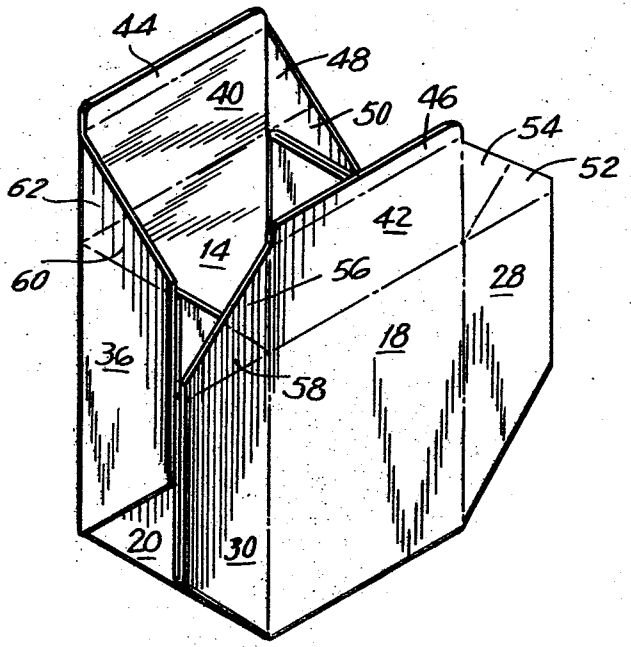
FIG. 4 depicts the following step in the folding sequence of the inner container.

As shown in FIG. 4, primary gusset panels 22, 24, 34, 36 and secondary gusset panels 48, 50, 60, 62 are folded about score lines 19, 29, 31, 33, 59, 61 so that primary gusset panels 24, 34 overlie and are in face-to-face contact with side walls 16, 20 respectively. As also shown in FIG. 4, primary gusset panels 26, 28, 30, 32 and third side wall 18 are folded about score lines 21, 15, 27 to a position perpendicular to bottom wall 12. This causes pairs of gusset panels 26 and 28 and 30, 32 to fold about diagonal score lines 37, 39 respectively into face-to-face position.

As shown in FIG. 5, primary gusset panels 26, 28, 30, 32 and secondary gusset panels 52, 54, 56, 58 are folded about score lines 21, 23, 25, 27, 69, 71 so that primary gusset panels 26, 30 overlie and are in face-to-face contact with side walls 16, 20 respectively. As also shown in FIG. 5, top walls 40, 42 are folded about score lines 43, 45 to lie in a plane parallel to bottom wall 12. This causes the pairs of secondary gusset panels 48, 50, 52, 54, 56, 58, 60, 62 to fold about diagonal score lines 51, 53, 55, 57 and score lines 63, 65, 67, 73 and to lie in face-to-face contact. Tuck-in flaps 44, 46, which meet in the center of the container, are then inserted into the container to thereby close the upper end thereof. In order to maintain the container in erected condition, an adhesive material is generally applied along the diagonal score lines and on the outer surfaces of primary gusset panels 24, 26, 32, 34 to secure them to second side walls 16, 20 respectively. Resin-based cold set adhesives or hot melt adhesives may be used for this purpose. As a result of the configuration of blank 10, the inner container erected therefrom is sift-proof. As previously mentioned, the outer surfaces of blank 10 are extrusion coated with a polyolefin, such as polyethylene, in order to render the inner container moisture-proof. The polyethylene is extrusion coated onto rolls of corrugated board which are subsequently cut and scored into blanks having the configuration illustrated in FIG. 1. Low density polyethylene is preferred, and it is generally of 0.5 to 0.75 mil thickness. FIG. 6 illustrates the closed inner container fabricated from the blank shown in FIG. 1.

As shown in FIG. 8, the top of the inner container may be sealed by use of strips of tape 64, 66, 68.

The outer container of this invention consists of a regular slotted container (RSC), which is provided with a tear strip encircling the upper end thereof to permit separation of the outer container into cover and body sections. As shown in FIG. 7, the outer container is fabricated from a unitary cut and scored blank 80. Blank 80, preferably, is fabricated from 350 test, double wall corrugated board. It comprises four side walls 82, 84, 86, 88 and a fifth wall or manufacturer's flap 90. These five walls are hingedly connected along score lines 81, 83, 85, 87. End walls are hingedly connected to opposite end edges of each of said side walls to form top and bottom walls. Thus, end walls 92, 96, 100, 104 are hingedly connected to the upper edges of side walls 82, 84, 86, 88 by means of score lines 89, 93, 97, 101 to form top walls for the outer container. In a like manner, end walls 94, 98, 102, 106 are hingedly connected to the lower edges of side walls 82, 84, 86, 88 along score lines 91, 95, 99, 103 respectively to form bottom walls for the outer container.

In order to permit access to the packaged solid material, blank 80 is provided with tear strip 105, which encircles the upper end of the outer container and permits it to be separated into cover and body sections 113, 112 respectively, as illustrated in FIG. 10.

The inner and outer containers are shipped to the end user in the form of knocked-down blanks. A wooden fixture may be employed to erect the inner container in the manner illustrated in FIGS. 2–6. The end user thus erects the inner container, fills it with a moisture-sensitive powdered or granular material, and seals it in the manner previously discussed. Next, as shown in FIG. 8, the sealed inner container is placed into the erected outer container, which is then sealed. When it is desired to gain access to the packaged material, the outer container is separated into cover section 113 and body section 112, as illustrated in FIGS. 9 and 10, by utilizing either tear tab 107 or 108, which are connected to opposite ends of tear strip 105. Tear tabs 107, 108 are defined by cut lines 109, 110 and 111. They are designed to be readily grasped by fingers to facilitate the removal of the cover section from the outer container. As illustrated in FIG. 10, the upper portion of the inner container, which is fabricated from blank 10 shown in FIG. 1, is constructed in such a manner as to provide a pair of pour spouts which permit dispensing of the contents of the container, act to prevent spillage when the contents are removed from the container by means of integral side walls, and are readily recloseable. Thus, one pour spout is defined by secondary gusset panels 52, 54, 56, 58, top wall 42, the tuck-in flap 46. The second pour spout is defined by secondary gusset panels 48, 50, 60, 62, top wall 40, and tuck-in flap 44. Because the upper end of the inner container is of a center tuck style, sides are provided for the pour spout.

As will be apparent from the foregoing disclosure and the drawings, the container of this invention is rigid, of high strength, and capable of being readily assembled, sealed, opened and reclosed. It can be stored in racks, which permit the easy dispensing of the contents therewithin. It is to be understood that the container of the present invention may be constructed from various grades of materials, from a variety of corrugated board constructions, and may be of an appropriate size and weight to accommodate the contents to be packaged therewithin.

The terms and expressions which have been employed herein are used as terms of description, for purposes of clarity. They are not limitations, and there is no intention in the use of such terms and expressions of excluding any equivalents of the features shown and described or portions thereof, but it is recognized that various modifications are possible within the scope and spirit of the invention and are defined by the claims appended hereto.

What is claimed is:

1. A sift-proof, shipping and dispensing container comprising an inner container fabricated from a unitary blank and a separate outer container fabricated from a unitary blank, said inner container comprising:

(a) a bottom wall;

(b) first, second, third and fourth side walls hingedly connected to said bottom wall along score lines;

(c) pairs of primary gusset panels hingedly connecting the side edges of the first and second, second and third, third and fourth, and fourth and first side walls, said primary gusset panels and said side walls being of equal height, and said primary gusset panels overlying the outer surfaces of said second and fourth side walls when the container is in erected condition;

(d) top walls hingedly connected to said first and third side walls along transverse score lines parallel to the score lines connecting said first and third side walls to said bottom wall;

(e) tuck-in flaps hingedly connected to said top walls along transverse score lines;

(f) pairs of secondary gusset panels hingedly connecting the top edges of the primary gusset panels which are connected to said first and third side walls to the side edges of said top walls;

said outer container comprising:

(g) four side walls;

(h) end walls hingedly connected to opposite end edges of each of said side walls to form top and bottom walls; and (i) a tear strip encircling the upper end of said outer container to permit separation thereof into cover and body sections.

2. A sift-proof, shipping and dispensing container according to claim 1 which is fabricated from corrugated board.

3. A sift-proof, shipping and dispensing container according to claim 2, wherein the outer surfaces of said inner container are coated with a polyolefin material to provide a moisture barrier.

4. A sift-proof, shipping and dispensing container according to claim 3 in which said polyolefin is polyethylene.

5. A sift-proof, shipping and dispensing container according to claim 4, wherein said primary gusset panels overlying the outer surfaces of said second and fourth side walls of said inner container are adhesively secured thereto.

6. A sift-proof, shipping and dispensing container according to claim 5, wherein said primary gusset panels overlying the outer surfaces of said second and fourth side walls of said inner container are adhesively secured thereto by means of a cold-set adhesive.

7. A sift-proof, shipping and dispensing container according to claim 5, in which said primary gusset panels overlying the outer surfaces of said second and fourth side walls of said inner container are adhesively secured thereto by means of a hot-melt adhesive.

8. A sift-proof, shipping and dispensing container according to claim 1, wherein said outer container includes a pair of tear tabs, each of said tabs being connected to opposite ends of said tear strip.

* * * * *